US005568885A

United States Patent [19]

Green

[11] Patent Number: 5,568,885

[45] Date of Patent: Oct. 29, 1996

[54] AGITATOR FOR LIQUID PUMP

[75] Inventor: Thomas S. Green, Atwater, Ohio

[73] Assignee: ABC Techcorp, Akron, Ohio

[21] Appl. No.: 403,178

[22] Filed: Mar. 13, 1995

[51] Int. Cl.[6] ..... B65D 88/54

[52] U.S. Cl. ..... 222/318; 222/459; 366/336

[58] Field of Search ..... 222/195, 196, 222/226, 318, 160, 399, 459, 424; 366/163.1, 163.2, 191, 336

[56] References Cited

U.S. PATENT DOCUMENTS 4,967,939 11/1990 Taylor ..... 222/424

5,335,828 8/1994 Kaiju et al. ..... 222/195

*Primary Examiner*—Andres Kashnikow

*Assistant Examiner*—Philippe Derakshani

*Attorney, Agent, or Firm*—Renner, Kenner Greive, Bobak Taylor & Weber

[57] ABSTRACT

A liquid dispensing system generally includes a liquid pump connected to a source of pressure and an outlet tube. A first valve regulates the flow of pressurized air or gas between the source of pressure and the liquid pump. The first valve also regulates air or gas from the liquid pump to the atmosphere. A second valve may regulate the flow of liquid from the liquid pump through the outlet tube. A controller manipulates the first valve to create a pressure head in the liquid pump and then manipulates the second valve to dispense liquid. When dispensing is complete, the controller closes the second valve and manipulates the first valve to exhaust the pressure head from the liquid pump. An agitator resides in the liquid inside of the liquid pump. The agitator has a housing having a chamber for accepting an increased portion of the liquid in response to the creating of the pressure head and for rejecting such increased portion of the liquid from the chamber in response to the exhaustion of the pressure head. Liquid enters the chamber through an inlet tube and an intermediate tube controlled by a first check valve and exits the chamber through an intermediate tube and an outlet tube controlled by a second check valve.

20 Claims, 2 Drawing Sheets

AGITATOR FOR LIQUID PUMP

TECHNICAL FIELD

The invention herein relates to the art of liquid dispensers and, more particularly, to a liquid dispensing system incorporating a liquid pump. Specifically, the invention relates to an agitator for a liquid pump that is driven by controlled pressure changes.

BACKGROUND ART

A method for dispensing liquid using a pressure driven liquid pump is well known in the art of liquid dispensing. Such a dispensing method generally employs a source of pressure connected to a liquid pump, a controller, and a set of valves. The liquid to be dispensed is located in the liquid pump along with a volume of air or other gas. To dispense liquid, the pump is sealed and then pressurized by the source of pressure. Subsequently, one of the valves is opened allowing the pressure in the pump to force the liquid out of the pump. When the desired amount of liquid has been dispensed the valve is closed and the pump is vented to atmosphere or otherwise depressurized.

Problems occur with this type of pump when the liquid residing in the pump is a suspension of two or more components. When a liquid suspension is at rest, the components naturally separate, as oil separates from water. One type of liquid suspension that is commonly dispensed using this type of pump is paint colorant. A paint colorant can be made up of a plurality of individual liquids or solids. When the colorant is at rest the various components will separate into different layers depending upon their relative weights and densities. When the pump is pressurized the component residing closest to the dispensing orifice, typically on the bottom of the pump, will first be dispensed. This is particularly undesirable when a paint colorant is being dispensed because the exact composition of a paint colorant is essential when mixing the colorant with a base to form a final paint color.

Prior attempts to remedy this problem have included placing an impeller inside of the pump to continuously or periodically agitate the liquid. Another prior art solution has been to place an electric pump inside of the liquid pump to continuously agitate the liquid. Both of these methods have undesired limitations. One limitation common to both prior solutions is that both the impeller and the electric motor require electricity to operate. The electricity must be supplied from outside of the liquid pump and thus an electrical conduit must run through the walls of the liquid pump. This is undesirable because the pump must be airtight for proper operation. The addition of the electric conduit increases the difficulty and expense of sealing the pump. Both prior solutions also require moving parts such as a motor to operate. The moving parts increase the likelihood of failure. Also, because the electric pump and the impeller are located inside of the liquid pump such a failure can not be readily detected by an operator.

DISCLOSURE OF INVENTION

In light of the foregoing, a first aspect of the present invention is to provide an agitator for a liquid pump that resides inside of the liquid pump and provides agitation in response to controlled pressure changes.

Another aspect of the present invention is to provide an agitator for a liquid pump that may be inserted into standard liquid pump.

A further aspect of the present invention is to provide an agitator that contains no moving parts, significantly increasing the reliability and durability thereof.

Yet another aspect of the present invention is to provide an agitator for a liquid pump that agitates liquid in response to the normal dispensing method.

Another aspect of the present invention is to provide an agitator for a liquid pump that can be connected to the inside of the liquid pump or can float freely in the liquid inside of the liquid pump.

A further aspect of the present invention is to provide such an agitator that takes liquid into a chamber in response to a pressure increase and ejects the liquid from the chamber in response to a pressure decrease.

In general, the present invention contemplates an agitator for a liquid pump, comprising: an inlet tube having first and second ends; an intermediate tube connected to said second end of said inlet tube; an outlet tube connected to said intermediate tube; a first valve disposed between said inlet tube and said intermediate tube such that fluid may only flow through said first valve from said inlet tube to said intermediate tube; a housing having an airtight chamber in continuous fluid connection with said intermediate tube; and a second valve disposed between said intermediate tube and said outlet tube such that fluid may only flow through said second valve from said intermediate tube to said outlet tube.

Other objects of the invention are attained by a liquid dispensing system for dispensing a liquid requiring agitation while at rest, the system comprising: a pump containing a liquid and a gas, said pump having at least a first and second opening, said liquid normally covering said second opening; a source of pressurized gas connected to said first opening; a first valve means for regulating fluid flow between said source of pressure and said pump, and for regulating fluid flow between said pump and the atmosphere; an outlet tube connected to said second opening; a second valve means for regulating fluid flow from said pump through said outlet tube; control means for selectively controlling said first valve means to create and exhaust a pressure head in said pump, and for selectively controlling said second valve means to dispense said liquid from said pump; and an agitator located in said liquid in said pump, said agitator comprising a housing having a chamber maintaining a portion of said liquid, said chamber developing a pressure head when said control means creates a pressure head in said pump, said pressure head in said chamber forcing said portion of said liquid from said chamber when said control means exhausts said pressure heads.

BRIEF DESCRIPTION OF DRAWINGS

For a complete understanding of the objects, techniques and structures of the invention, reference should be made to the following detailed description and accompanying drawings wherein.

BEST MODE FOR CARRYING OUT THE INVENTION

Figure 1:
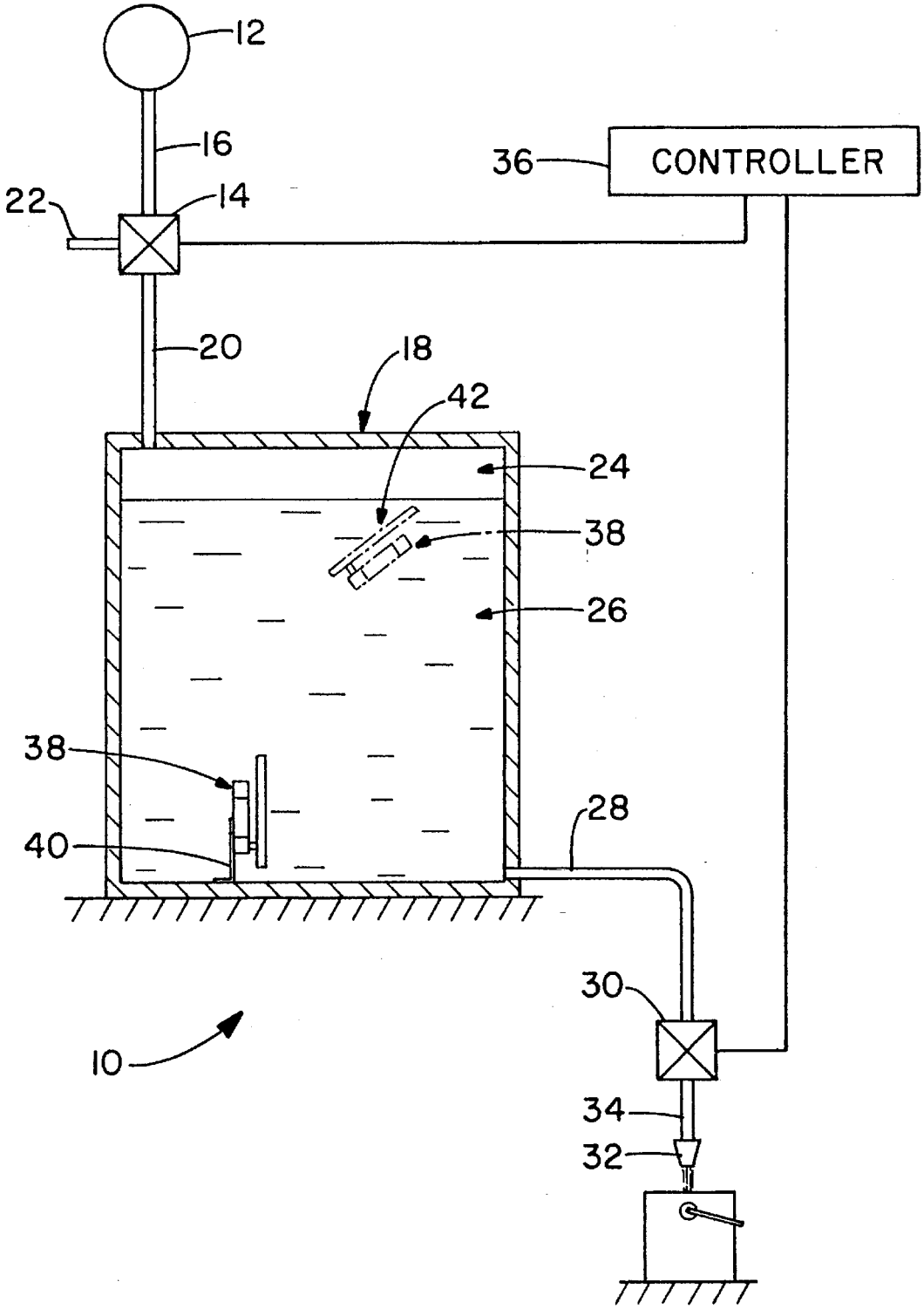
FIG. 1 is an illustrative representation of the components in a liquid dispensing system employing the invention.

Referring now to the drawings and more particularly to FIG. 1, it can be seen that a liquid dispensing system employing the invention is designated generally by the numeral 10. The system includes a source of gas or air pressure 12 connected to a three-way valve 14 by a first conduit 16. The three-way valve 14 is connected to a pump 18 by a second conduit 20. The three-way valve 14 can also be vented to the atmosphere by a third conduit 22. Thus the three-way valve 14 can be manipulated to provide a path between the source of pressure 12 and the pump 18, or between the pump 18 and the atmosphere. When the three-way valve 14 is manipulated to provide a path between the pump 18 and the atmosphere, gas or air will flow from the area of higher pressure to the area of lower pressure. For instance, if the gas or air pressure head 24 in the pump 18 were at a higher pressure than the atmosphere, the gas or air of the head 24 in the pump 18 would flow from the pump 18 out to the atmosphere until the head 24 in the pump 18 reached the pressure of the atmosphere. This is known as "bleeding" or "exhausting" the pressure from the pump 18. The three-way valve 14 can be selectively manipulated to control the rate that the head 24 in the pump 18 escapes during bleeding. When the three-way valve 14 is slightly opened, slow bleeding or exhausting occurs. When the three-way valve 14 is fully opened, fast bleeding or exhausting occurs.

The pump 18 is generally a sealed container holding liquid 26 and gas or air head 24 that is connected to a pressurizing and venting conduit 20 and outlet tube 28. The outlet tube 28 provides a connection between the pump 18 and a two-way valve 30. The two-way valve 30 is connected to a dispensing head 32 by a dispensing tube 34. The dispensing tube 34 can also connect the two-way valve 30 to another dispensing system or another container.

A controller 36 is in connection with the three-way valve 14 and the two-way valve 30. The controller 36 selectively manipulates both valves 14, 30 to direct flow through the dispensing system. The controller 36 can be operated manually or be operated by an automatic control program. When liquid is to be dispensed from the pump 18, the two-way valve 30 is in its normally closed position. The controller 36 manipulates the three-way valve 14 to provide a path between the source of pressure 12 and the pump 18. When this occurs the pump 18 will become pressurized with a pressure head 24 which is at the same pressure as the source of pressure 12. At this time, the controller 36 opens the two-way valve 30 and the liquid in the pump 26 is forced through the outlet tube 28, the dispensing tube 34, and through the dispensing head 32 by the pressure head 24 in the pump 18. When dispensing is complete, the controller 36 closes the two-way valve 30. The controller 36 then manipulates the three-way valve 14 to close the path between the source of pressure 12 and the pump 18. If desired, the controller 36 can further manipulate the three-way valve 14 to bleed or exhaust the gas or air from the head 24, thus releasing the pressure from the pump 18.

If the source of pressure 12 is a variable pressure source, the amount of pressure introduced into the pump 18 will directly control the flow rate of liquid 26 from the pump 18. The two-way valve 30 can also be used to control the flow rate of the liquid 26 from the pump 18 by opening and closing it at selected duty cycles. The controller 36 controls the flow rate in each of these situations. Another method to control the flow rate from the pump 18 is to selectively open and close the three-way valve 14.

The above described method dispenses the liquid 26 from the pump 18. When the liquid 26 in the pump 18 separates while at rest, as in the case of a liquid suspension, agitation of the liquid 26 is required to maintain the desired properties of the liquid 26. Two agitators 38 are shown residing in the liquid pump 18 in FIG. 1. In the preferred embodiment of the present invention, an agitator 38 is connected to the liquid pump 18 by any suitable mounting device 40. In an alternative embodiment of the present invention, the agitator 38 is floating freely in the liquid 26 in the liquid pump 18, as at 42. In a second alternative embodiment of the present invention, a plurality of agitators 38 reside in the liquid pump 18. When the agitator 38 floats freely in the liquid 26, the agitator 38 will either float on the surface of the liquid 26 or sink to the bottom of the liquid 26 depending upon the state of the agitator 38 and the density of the liquid 26.

Figure 2:
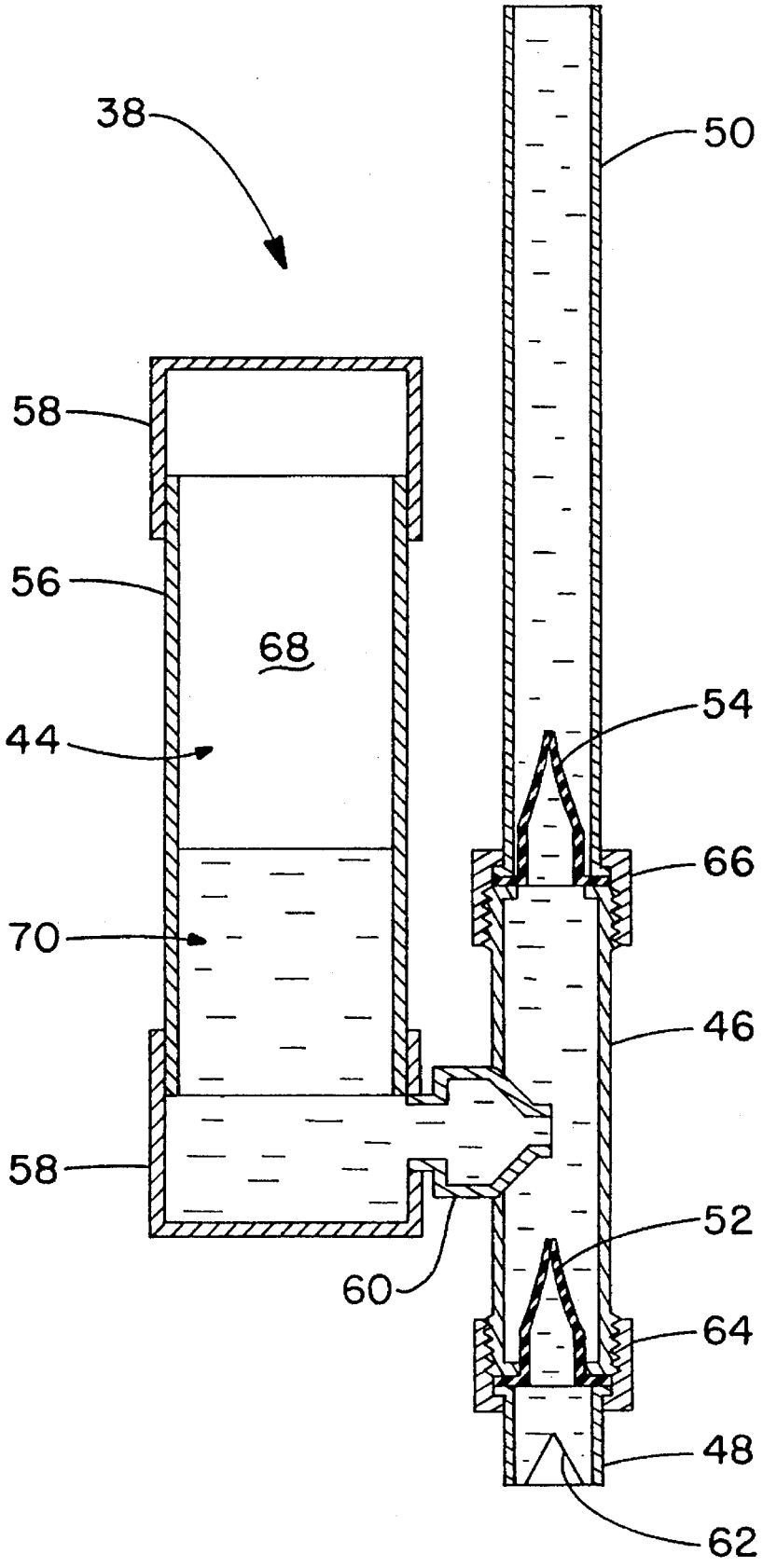
FIG. 2 is a cross sectional side view of an agitator for a liquid pump according to the invention.

Referring now to FIG. 2, a cross sectional side view of an agitator 38 according to the invention can be seen. The agitator 38 generally comprises a chamber 44 connected to a series of tubes 46, 48, and 50 that are separated by a pair of check valves 52, 54. In the preferred embodiment of the invention, the chamber 44 is formed from a cylindrical tube 56 sealed at both ends by a pair of end caps 58. To achieve the goals of this invention, however, the chamber 44 need only be air tight and provide a connection for a bridge tube 60. The bridge tube 60 creates a connection between the chamber 44 and an intermediate tube 46. The intermediate tube 46 has first and second openings, each of which is regulated by a check valve 52, 54. In the preferred embodiment of this invention, each valve is an elastomeric, duck billed valve. Each valve 52, 54 is a check valve, permitting single direction liquid flow therethrough. An inlet tube 48 is connected to the intermediate tube 46 such that the first valve 52 regulates the flow of liquid between the inlet tube 48 and the intermediate tube 46. A notch 62 is disposed in one end of the inlet tube 48 to assure that liquid 26 can always enter the inlet tube 48. A nut 64 serves to connect between the inlet tube 48 to the intermediate tube 46 while securing the check valve 52 in place. Similarly, an outlet tube 50 is connected to the intermediate tube 46 such that the second check valve 54 regulates liquid flow between the intermediate tube 46 and the outlet tube 50. A second nut 66 connects the outlet tube 50 to the intermediate tube 46 while holding the second check valve 54 in place. The second check valve 54 is necessary only to ensure that liquid is drawn into the agitator 38 through the inlet tube 48. This is desirable when the agitator 38 is secured to the pump 18 to draw liquid 26 from the bottom of the pump 18 and eject it towards the top of the pump 18. The second check valve 54 can be eliminated if this function is not desired. Furthermore, the second check valve 54 may be replaced with an outlet tube 50 having a smaller diameter than the inlet tube 48. The effect of the smaller diameter will be the same as the second check valve 54 because liquid will tend to be drawn into the agitator 38 through the larger inlet tube 48 instead of the smaller outlet tube 50. As the diameter of the outlet tube 50 is reduced, a larger percentage of liquid will be drawn through the inlet tube 50.

The agitator 38 operates by taking liquid 26 in through the inlet tube 48 and subsequently ejecting the liquid 26 through the outlet tube 50. If the agitator 38 is connected to the pump 18 by means such as the bracket 40, liquid 26 from the bottom of the pump 18 will be pushed to the top of the pump 18 by the agitator 38. If the agitator 38 is floating freely in the liquid 26 as at 42, the agitator 38 will propel itself by ejecting the liquid 26 from the outlet tube 50. In this case the liquid 26 will be randomly mixed. When the agitator 38 is not restrained, it sinks as it fills and rises as it ejects. Accordingly, vertical mixing is achieved due to the rising and falling of the agitator 38 as it empties and refills with liquid. This action achieves a thorough mixing and prevents stratification.

The agitator 38 is driven by pressure changes in the pump 18. Initially, the chamber 44 is filled with air at atmosphere pressure. The pump 18 is opened and the agitator 38 is placed in the liquid 26 inside of the pump 18. The pump 18 is then sealed and the controller 36 serves to operate the pump 18 and agitator 38 as follows. As discussed above, with the two-way valve 30 closed the controller 36 opens the three-way valve 14 to allow the source of pressure 12 to communicate with the pump 18. As the pump 18 is pressurized, liquid 26 is forced into the agitator 38 through the inlet tube 48 because the chamber 44 and the intermediate tube 46 are at atmospheric pressure. The liquid 26 that is being forced into the agitator 38 by the increased pump pressure fills the intermediate tube 46 and the chamber 44 until the air trapped in the chamber 44 defines a pressure head 68 which equals the pump pressure and the pump pressure head 24. In this state, the chamber 44 is filled with liquid 70 and a pressure head 68 of air or gas, at the pressure of the pump pressure head 24.

To eject the liquid 70 out of the chamber 44, the controller 36 manipulates the three-way valve 14 to bleed the pressure from the pump 18. As previously described, the bleed rate can be regulated. The bleed rate will establish the rate that the liquid 70 leaves the chamber 44. If the controller 36 directs a fast bleed rate, the liquid 70 will be quickly ejected out of the agitator 38. If the controller 36 selects a slow bleed rate, the liquid 70 will be slowly pushed out of the agitator 38. When bleeding starts, pressure drops in the pump 18 and the pressure head 68 trapped in the chamber 44 pushes the liquid 70 in the chamber 44 out through the bridge tube 60 and into the intermediate tube 46 as the head in the chamber 68 seeks to equal the pump pressure head 24. The first check valve 52 prevents the liquid 70 from flowing from the intermediate tube 46 to the inlet tube 48. The second valve 54 allows the liquid 70 to flow from the intermediate tube 46 to the outlet tube 50. The pressure head 68 trapped in the chamber 44 continues to push liquid 70 out of the chamber 44 and the intermediate tube 46 until the pressure head 68 in the chamber 44 equal the pump pressure head 24 of the pump 18. If the agitator 38 is freely floating in the liquid 26, the agitator 38 may rise to the top of the liquid 26 as the chamber 44 empties. The force of the liquid leaving the outlet tube 50 will also propel the agitator 38 if the agitator 38 is freely floating in the liquid 26. It can now be understood that maximum agitation is obtained from an individual agitator 38 by pressurizing the pump 18 to the maximum pressure and then releasing that pressure as fast as possible. The release will cause the pressure head 68 in the chamber 44 to expand quickly thereby ejecting the liquid 70 out of the agitator 38 in a violent manner. On the other hand, if the pressure head 24 is slowly released, the liquid 70 will slowly leave the outlet tube 50 and not create a large amount of agitation.

To repeat the agitation process, the controller 36 manipulates the three-way valve 14 to create a pressure head 24 in the pump 18. As the pump 18 is pressurized the agitator 38 is recharged with liquid 70 and a resultant pressure head 68. When the pump 18 is depressurized the agitator 38 ejects the liquid 70 and the agitation process is repeated. The agitation process, therefore, occurs automatically each time liquid 26 is dispensed. If additional agitation is desired, the controller 36 can be directed to pressurize and depressurize the pump 18 multiple times without dispensing any liquid 26. This is achieved by maintaining the two-way valve 30 in its closed position while manipulating the three-way valve 14 to supply pressure and subsequently bleeding pressure from the pump 18. If continuous agitation is desired, the controller 36 can repeat the pressurization and depressurization process continuously. If even more agitation is desired, the chamber 44 may be enlarged, additional agitators 38 may be added to the pump 18, or the pressure heads 24, 68 may be increased.

It can be seen that the objects of the invention have been satisfied by the techniques and apparatus presented hereinabove. While in accordance with the present statutes, only the best mode and preferred embodiment of the invention has been presented and described in detail, it is to be understood that the invention is not limited thereto or thereby. Accordingly, for an appreciation of the true scope and breadth of the invention, reference should be made to the following claims.

What is claimed is:

1. An agitator for a liquid pump, comprising:

an inlet tube having first and second ends;

an intermediate tube connected to said second end of said inlet tube;

an outlet tube connected to said intermediate tube;

a first valve disposed between said inlet tube and said intermediate tube such that fluid may only flow through said first valve from said inlet tube to said intermediate tube; and a housing having an airtight chamber in continuous fluid connection with said intermediate tube.

2. An agitator for a liquid pump according to claim 1, wherein said housing is connected to said intermediate tube by a bridge tube, said bridge tube engaging said housing at one end of said chamber.

3. An agitator for a liquid pump according to claim 2, wherein said housing is generally cylindrical.

4. An agitator for a liquid pump according to claim 3, wherein said chamber is generally cylindrical.

5. An agitator for a liquid pump according to claim 1, further comprising:

a second valve disposed between said intermediate tube and said outlet tube such that fluid may only flow through said second valve from said intermediate tube to said outlet tube;

each of said valves is an elastomeric, duck-billed check valve.

6. An agitator for a liquid pump according to claim 1, wherein said outlet tube is longer than said inlet tube.

7. An agitator for a liquid pump according to claim 1, wherein said inlet tube is connected to said intermediate tube by a threaded nut.

8. An agitator for a liquid pump according to claim 1, wherein said first end of said inlet tube is notched.

9. An agitator for a liquid pump according to claim 1, wherein said intermediate tube is connected to said outlet tube by a threaded nut.

10. A liquid dispensing system for dispensing a liquid requiring agitation while at rest, the system comprising:

a pump containing a liquid and a gas, said pump having at least a first and second opening, said liquid normally covering said second opening;

a source of pressurized gas connected to said first opening;

a first valve means for regulating fluid flow between said source of pressure and said pump, and for regulating fluid flow between said pump and the atmosphere;

an outlet tube connected to said second opening;

a second valve means for regulating fluid flow from said pump through said outlet tube;

control means for selectively controlling said first valve means to create and exhaust a pressure head in said pump, and for selectively controlling said second valve means to dispense said liquid from said pump; and an agitator located in said liquid in said pump, said agitator comprising a housing having a chamber maintaining a portion of said liquid, said chamber developing a pressure head when said control means creates a pressure head in said pump, said pressure head in said chamber forcing said portion of said liquid from said chamber when said control means exhausts said pressure heads.

11. A liquid dispensing system according to claim 10, wherein said outlet tube has first and second ends, said first end connected to said pump, said second end connected to a dispensing head.

12. A liquid dispensing system according to claim 10, wherein said housing and said chamber are generally cylindrical.

13. A liquid dispensing system according to claim 10, wherein said agitator further comprises an intermediate tube connected to an inlet tube and an outlet tube, said intermediate tube being in continuous fluid connection with said chamber.

14. A liquid dispensing system according to claim 13, wherein the connection between said inlet tube and said intermediate tube is regulated by a first check valve such that fluid may only flow from said inlet tube to said intermediate tube.

15. A liquid dispensing system according to claim 13, wherein the connection between said intermediate tube and said outlet tube is regulated by a second check valve such that fluid may only flow from said intermediate tube to said outlet tube.

16. A liquid dispensing system according to claim 13, wherein said inlet tube has a first end and a second end, said second end connected to said intermediate tube and said first end being notched.

17. A liquid dispensing system according to claim 13, wherein said inlet tube is connected to said intermediate tube by a threaded nut, and said intermediate tube is connected to said outlet tube by a threaded nut.

18. A liquid dispensing system according to claim 14, wherein said first check valve is an elastomeric, duck-billed valve.

19. A liquid dispensing system according to claim 15, wherein said housing and said chamber are generally cylindrical.

20. A liquid dispensing system according to claim 13, wherein the area of fluid connection between said outlet tube and said intermediate tube is smaller than the area of fluid connection between said inlet tube and said intermediate tube.

* * * * *